US005915656A

United States Patent [19]

Grewe

[11] Patent Number: 5,915,656

[45] Date of Patent: Jun. 29, 1999

[54] MODULAR FLOOR STAND

[76] Inventor: Ronald E. Grewe, 22437 Cranbrooke Dr., Novi, Mich. 48375

[21] Appl. No.: 08/935,420

[22] Filed: Sep. 23, 1997

[51] Int. Cl.[6] ..... A47G 23/02

[52] U.S. Cl. ..... 248/150; 248/469; 40/606; 40/607

[58] Field of Search ..... 248/150, 453, 248/466, 469, 448; 40/606, 607, 612

[56] References Cited

U.S. PATENT DOCUMENTS

| | | | |
|---|---|---|---|
| 1,260,095 | 3/1918 | Timberlake | 248/469 |
| 1,439,982 | 12/1922 | Shrauger | 40/607 |
| 1,804,770 | 5/1931 | Hershfield | 40/606 |
| 1,857,423 | 5/1932 | Zadek | 40/606 |
| 2,791,851 | 5/1957 | Richter | 40/606 |
| 5,730,547 | 3/1998 | Nogami | 248/230.1 |

*Primary Examiner*—Ramon O. Ramirez
*Assistant Examiner*—Robert Lipcsik

[57] ABSTRACT

A floor stand device made primarily of modular components and used for displaying pictures, posters, and other display materials. A frame assembly is supported on a horizontal support assembly which is connected to a vertical support member and in turn to a base member. The horizontal support assembly includes a center support member, a pair of horizontal support members, and a pair of L-shaped side support members. Preferably, the parts are sized to be press-fit and secured together. Fasteners positioned through the frame assembly members into the horizontal support assembly and optionally into the side support members, retain the floor stand device together.

12 Claims, 3 Drawing Sheets

MODULAR FLOOR STAND

TECHNICAL FIELD

The present invention relates to floor stands for holding posters, pictures, and other display materials.

BACKGROUND ART

There are a number of structures and devices for displaying posters, pictures, advertisements and other display materials at places of business or at other places for viewing by passers by. These devices can display attractive pictures or photographs, provide information to the public about various business promotions or items of interest, or include advertising materials for goods or services.

The display structure include a wide variety of various forms and types. The advertising displays and poster materials can be displayed on walls or other flat surfaces, or on poles or columns. The displays can be hung from ceilings or other structures, or be freestanding in a floor area. Many of these display devices include poster frames of one type or another for displaying the materials. With floor stands, the display materials are usually included on a single or multiface panel device that either rests on the floor or is attached to a pedestal or base of some type.

Many of the floor stands known today are satisfactory and have had significant commercial success. Many of the floor stands, however, are expensive to manufacture and assemble, are not aesthetically pleasing, and cannot be easily transported or moved to different locations. Moreover, many of the floor stand devices are not adaptable for use with frames or display materials of various sizes.

SUMMARY OF THE INVENTION

It is an object of the present invention to provide an improved floor stand device. It is also an object of the present invention to provide an improved floor stand device which has a modular structure which can accommodate various sizes of components and materials.

It is also an object of the present invention to provide an improved floor stand device which is less expensive and easier to manufacture and assemble. It is a still further object of the present invention to provide a modular-type floor stand device which is customer-friendly, provides an aesthetic appearance, is easily portable and movable, and is adaptable to components and materials of different sizes.

These and other objects and purposes are accomplished by the present invention. The present invention provides a floor stand device which is customer-friendly, is relatively simple to manufacture and assemble, is less expensive to manufacture, and which can be shipped in smaller packages for ready assembly at the display site. The present invention comprises a frame assembly connected to a vertical support member and supported by a base member. A center support member is press-fit into the vertical support member and a pair of horizontal support member connected to L-shaped side supports are adapted to be connected thereto. The frame assembly has a two-sided display area and is positioned on the horizontal supports and inside the side supports. The various components are held together with a minimum of fasteners.

These and other features and advantages of the present invention will become apparent from the following description of the invention when viewed in accordance with the accompanying drawings and appended claims.

BEST MODES FOR CARRYING OUT THE INVENTION

Figure 1:
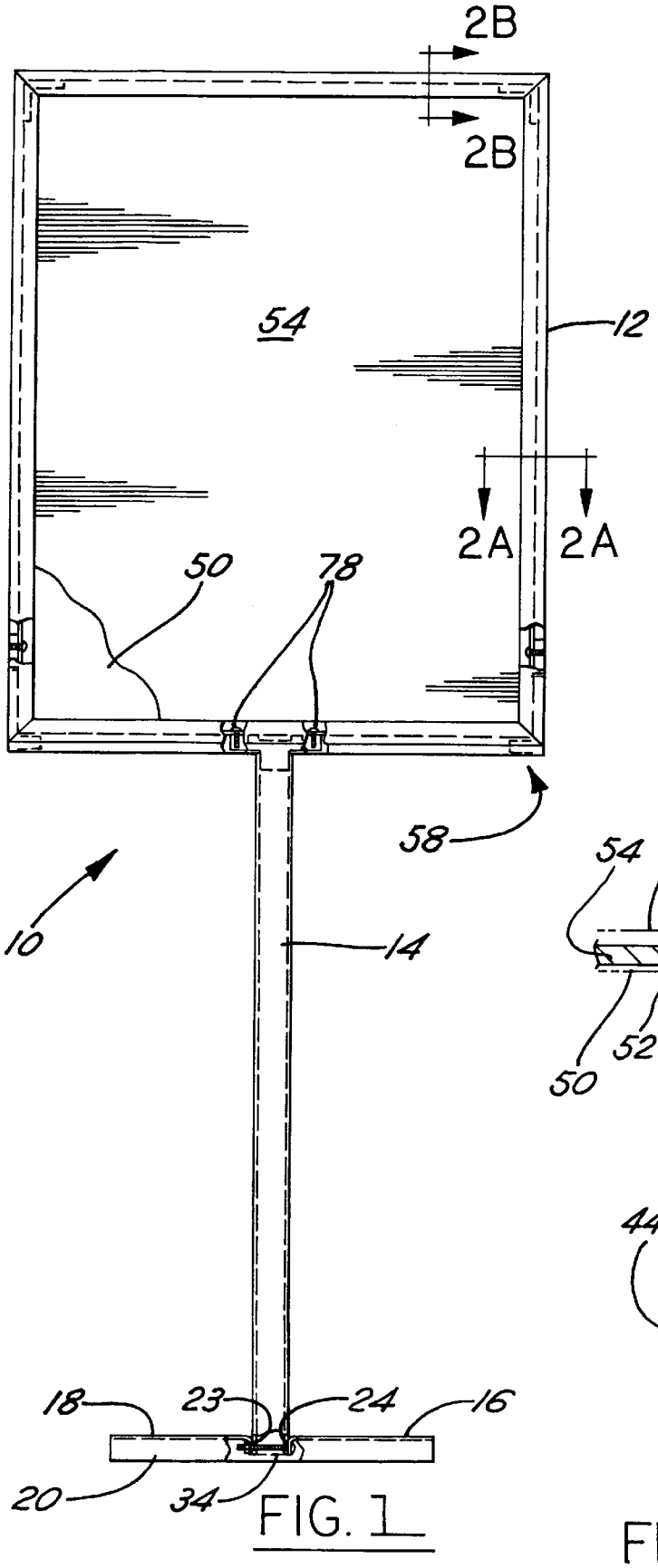
FIG. 1 illustrates a modular floor stand made in accordance with the present invention.

FIGS. 1–8 illustrate a preferred embodiment of the present invention. For reference purposes, the modular floor stand device in accordance with the present invention is generally referred to by the reference numeral 10.

The floor stand device generally includes a frame assembly 12, a vertical support member 14, and a base member 16. As shown in FIG. 1, the base member 16 is secured to and supports the vertical support member 14 which, in turn, supports and displays the frame assembly 12. The base member 16 is adapted to be positioned on a flat or horizontal surface for display of the floor stand 10.

All of the various components comprising the modular floor stand are preferably made from a metal or plastic material, or a combination thereof. The preferred metal is extruded aluminum, while the preferred plastic material is polyamide (nylon).

The base member 16 generally comprises a U-shaped member with a flat upper surface 18 and a pair of ground-engaging flanges or leg members 19 and 20. The base member 16 has a central opening 22 with turned down flange members 23 and 24. A fastener, such as bolt 26, nut 27 and washer 28, are used to secure the vertical support member 14 to the base member 16 through openings 31 and 32 in the flange members 23 and 24. This is shown in FIGS. 1 and 3.

The floor stand device 10 in accordance with the present invention is constructed such that both sides of the frame assembly are substantially the same and thus that the floor stand will appear to be the same from either direction to passers by. Also, the same display materials can be presented on both sides.

Figure 3:
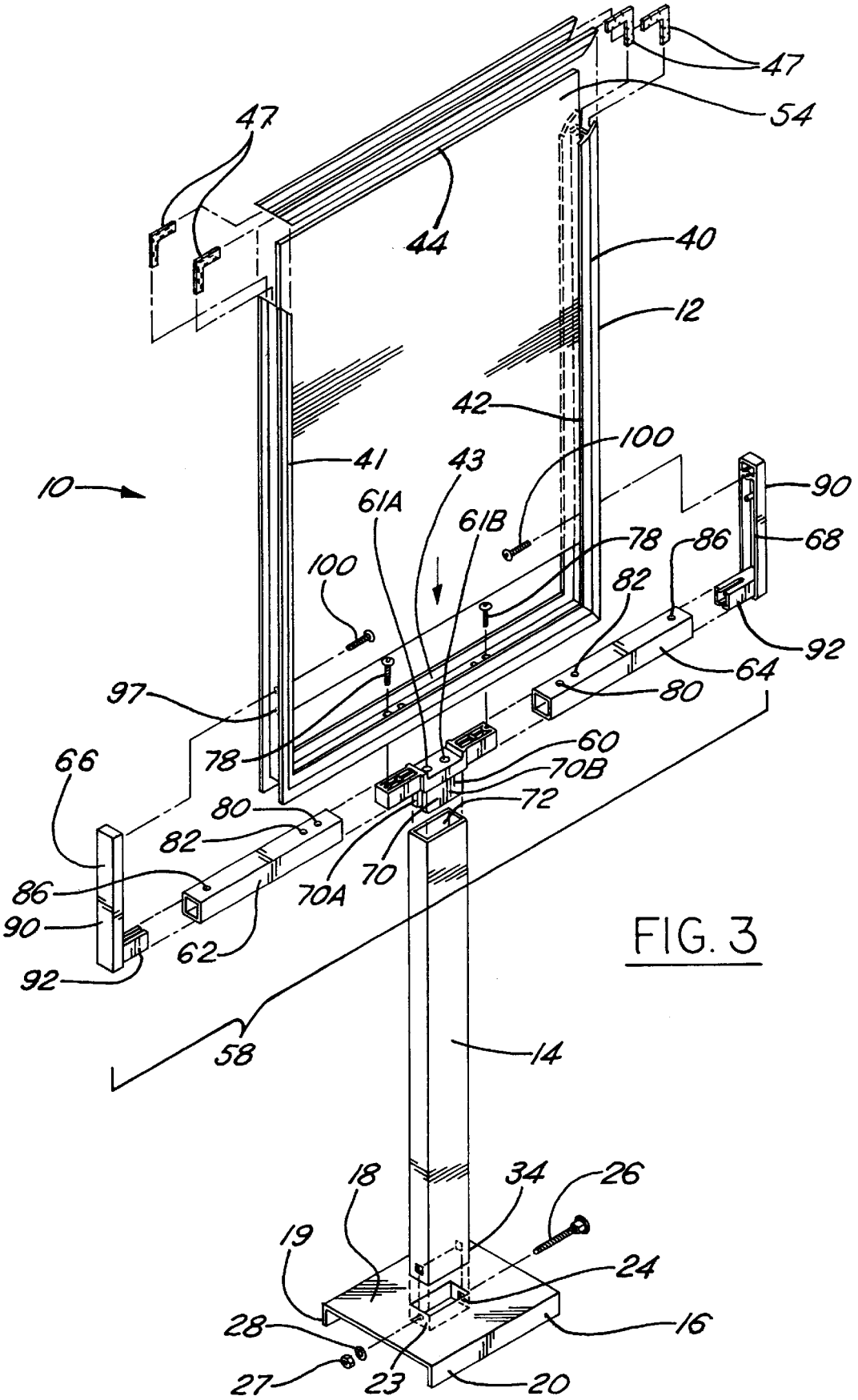
FIG. 3 is an exploded view of a modular floor stand in accordance with the present invention.
Figure 5:
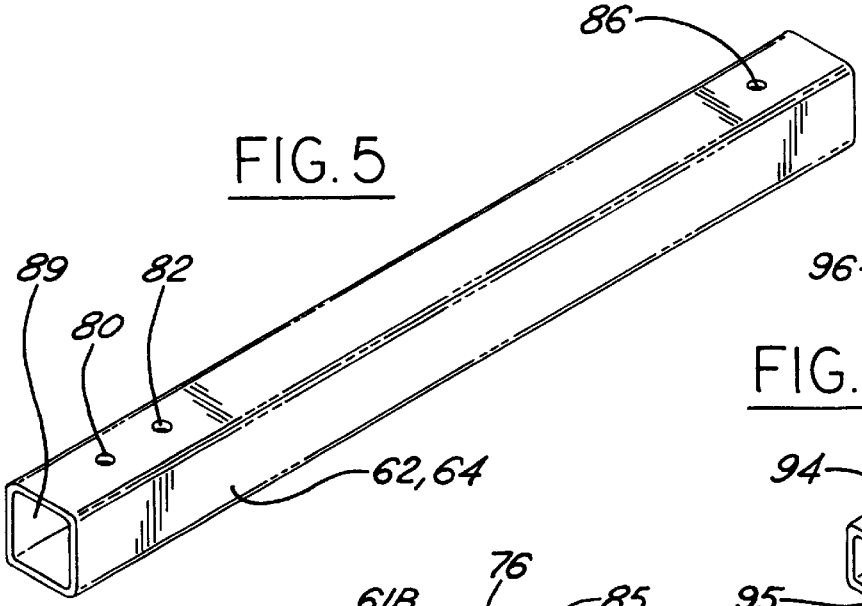
FIG. 5 illustrates one of the horizontal support members for use with the present invention.
Figure 7:
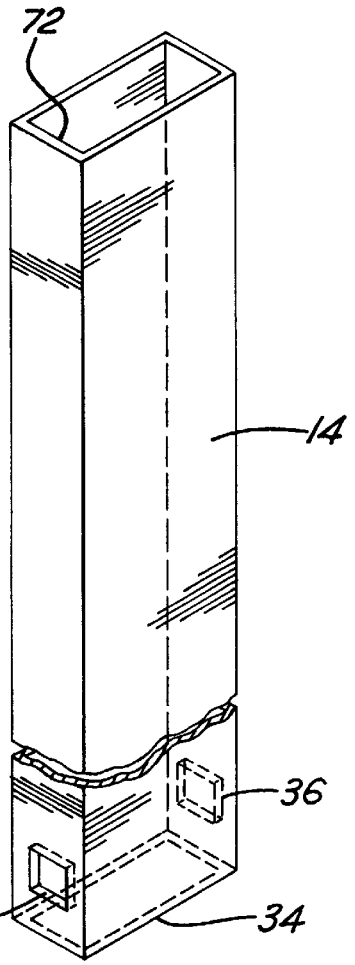
FIG. 7 illustrates a vertical support member utilized with the present invention.
Figure 8:
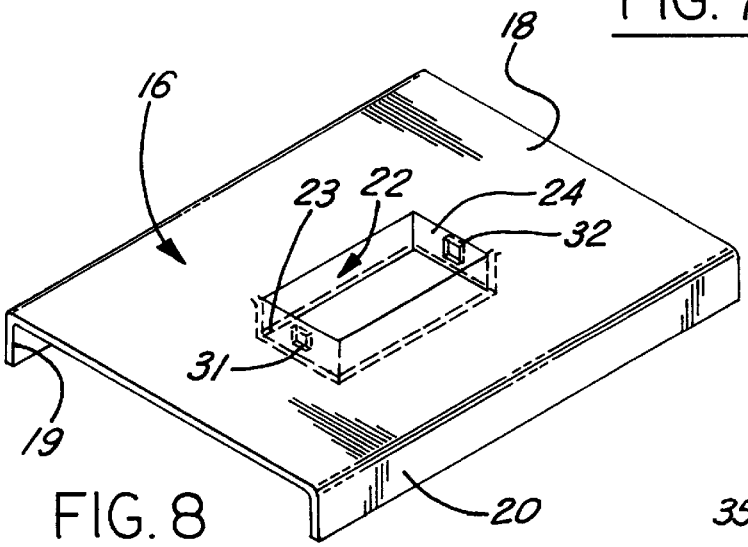
FIG. 8 illustrates a base member preferably utilized with the present invention.

The vertical support member 14, which is shown in FIGS. 1, 3, and 7, is basically a hollow tubular member which connects the base member 16 to the frame assembly 12. The lower end 34 of the vertical support member 14 has a pair of openings 35 and 36 which are used to hold the vertical support member to the base member 16. The openings 35 and 36 are designed to mate and align with openings 31 and 32 in the flanges 23 and 24 in the base member 16 such that fastener mechanism 26 can be positioned there through and hold the two members 16 and 14 together.

Figure 2A:
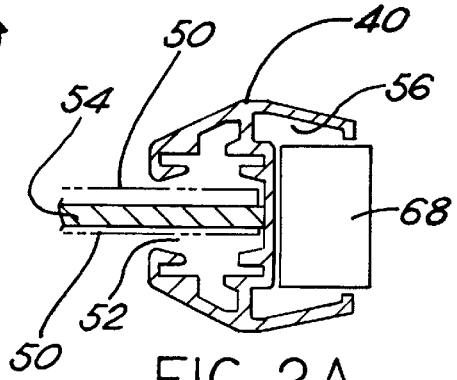
FIGS. 2A and 2B are cross-sectional views of portions of the floor stand of FIG. 1, the cross-sections being taken along lines 2A—2A and 2B—2B, respectively, in FIG. 1 and in the direction of the arrows.
Figure 2B:
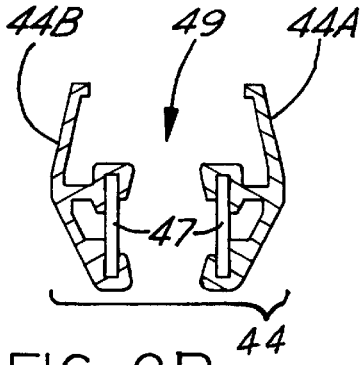

The frame assembly 12, as shown in FIGS. 1 and 3, comprises the plurality of frame sections each of which have the cross-sectional sizes and shapes as shown in FIGS. 2A or 2B. As is evident from FIGS. 1 and 3, four frame sections 40 are provided forming the rectangular or square frame assembly 12 which is used on the floor stand device 10. The four frame sections 40 are mitered at 45° angles in their corners. The two side frame sections 41 and 42 are held in place adjacent to lower frame section member 43 by the support system as described below. The size and shape of the cross-sections of frame sections 41, 42 and 43 are shown in FIG. 2A. The uppermost frame section 44 is made from two frame members 44A and 44B which are attached to the side frame members 41 and 42 by barbed corner key members 47 (see FIG. 2B). A slot or slit 49 is provided between the two frame members 44A and 44B in order to remove and replace posters and other display indicia 50 in the frame assembly 12.

Each of the frame members 41, 42 and 43 has a central channel 52 for placement and holding of a backing member 54. Each of the frame members 41, 42 and 43 also has an outer or external elongated channel or cavity 56, one of the reasons for which is placement of the side support members as indicated below.

The frame assembly 12 is supported on the floor stand device 10 by a supporting mechanism or system 58. The supporting mechanism includes a center support member 60, a pair of horizontal support members 62 and 64, and a pair of side support members 66 and 68. The two horizontal support members 62 and 64 are identical, as are the two side support members 66 and 68.

Figure 6:
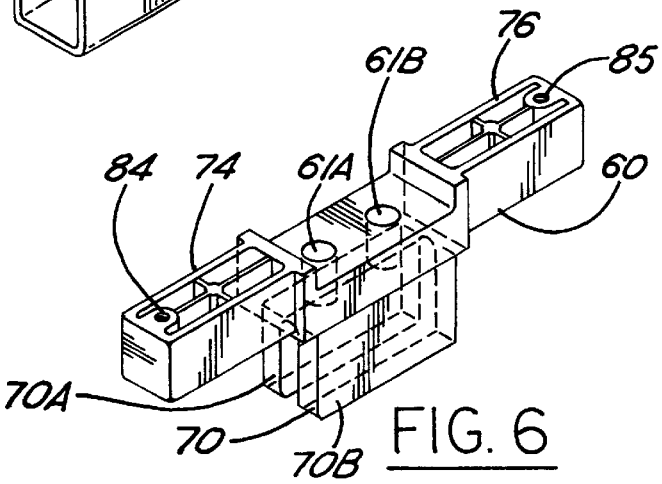
FIG. 6 illustrates a center support member preferably utilized with the present invention.

The center support member 60 is best shown in FIG. 6. The member 60 includes a plug member 70 which is adapted to be press-fit into the upper end 72 of the vertical support member 14. Also, for additional fixation, one or more fasteners can be installed through openings 61A and/or 61B in member 60 thereby urging or forcing split tabs 70A and 70B apart and connecting member 60 more securely to the vertical support member.

The center support member 60 also includes a pair of outwardly extending connecting insert members 74 and 76 which are adapted to snugly fit within the inner ends of the horizontal support members 62 and 64. When the horizontal support members are positioned on the center support member 60, as shown in FIG. 1, fastener members, such as screws 78, are secured through one of openings 80 or 82 in the horizontal support members 62 and 64 and into recesses 84 or 85 in the insert arms 74 and 76. In this regard, preferably a number of aligned openings are provided in the horizontal support members 62 and 64 such that the width of the floor stand device can be modified to accommodate frame assemblies 12 of different widths and sizes.

The horizontal support members 62 and 64 also have an additional opening 86 at their opposite ends for being secured to one of the side support members 66 or 68.

Figure 4:
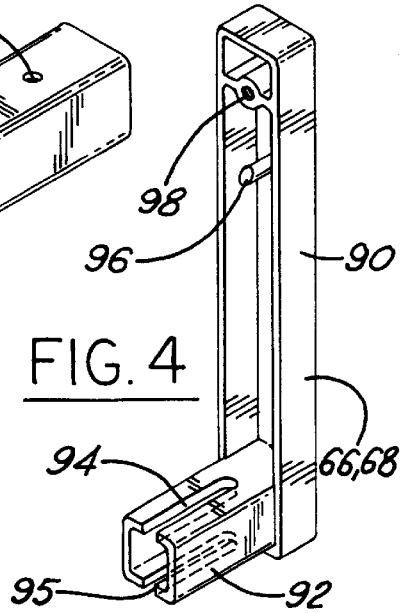
FIG. 4 illustrates one of the L-shaped side support members for use with the present invention.

The side support members are generally L-shaped and have the configuration shown in FIG. 4. In this regard, the side support members 66 and 68 have a longer vertically oriented portion 90 and a shorter horizontally disposed interlocking insert portion 92. The insert portion 92 is adapted to be inserted in—and preferably be snugly fit within—the inside cavity 89 of the horizontal support members 62 and 64.

The insert portions 92 of the side support members 66,68 are provided with U-shaped slots 94 and 95. The slots are used to secure the side support members to the horizontal support members with fasteners positioned through opening 86 in the horizontal support members. When fasteners are installed in the slots 94 and 95, the two halves of the insert portions 92 are forced outwardly securely holding the side support members in place inside the horizontal support members. The upright portions 90 of the side support members 66 and 68 are adapted to fit within the outer or external cavity or channel 56 on the frame members 40. (See FIG. 2.)

The vertical portion 90 also has a post member 96 and an optional fastener-receiving socket or opening 98, both as shown in FIG. 4. The post member 96 is positioned to fit within opening 97 on frame members 41 and 42, while the socket or fastening receiving member 98 is adapted to receive fastener 100 which is positioned through frame members 41 and 42 to interlock and hold the various floor stand members together.

The present invention provides a floor stand which is comprised of a plurality of modular parts which are simple and inexpensive to manufacture and which can be easily assembled together, particularly at the display site. For assembly, the base member 16 is first attached to the vertical upright member 14 with the fastener 26, washer 28, and nut 27. Next, the center support member 60 is positioned in the top 72 of the vertical support member 14 and the two horizontal support members 62 and 64 are slid onto the insert members 74 and 76, respectively.

The frame assembly 12, which comprises the four frame members 41, 42, 43 and 44 is then positioned on the horizontal support assembly 58 (the center support member and two horizontal support members). The frame member 43 is then secured to the horizontal support assembly by fasteners 78 which are positioned through the frame member 43 and the horizontal support members 62 or 64 and secured in the sockets or openings 84 in the center support member. These two fasteners 78 thus securely hold the frame assembly 12 to the center support member 16 and simultaneously to the two horizontal support members 62 and 64.

Thereafter the two side support members 66 and 68 are attached by sliding the insert portions 92 into the open ends of the horizontal support members. Due to the press-fit relationship between the insertion portions 92 and horizontal support members 62 and 64, it may not be necessary to utilize fasteners through openings 86 and into slots 94 and 95. However, if additional securing is desired or needed, then fasteners can be utilized. Also, fasteners 100 can be positioned through frame members 41 and 42 and into the sockets 98 in the side support members to securely hold the frame assembly and remainder of the floor stand device together.

Thereafter, the backing member 54, which can be a piece of corrugated material, is inserted into the frame assembly 12 and positioned in the center thereof. Thereafter, posters, pictures or other display materials 50 are positioned on opposite sides of the backing member 54 and the uppermost frame member 44 is tightly secured in place.

While the best modes for carrying out the invention have been described in detail, those familiar with the art to which this invention relates will recognize various alternative designs and embodiments for practicing the invention as defined by the following claims.

What is claimed is:

1. A floor stand display device comprising:

a base member;

a vertical upright member positioned on said base member, said vertical upright member having a hollow first end and a second end, said second end connected to said base member;

a center support member positioned on said vertical upright member, said center support member having a body portion, a first insert member, and a second opposed inset member, said body portion having a pair of spaced apart tab members positioned inside said hollow first end of said vertical upright member;

a first horizontal support member connected to said first insert member and a second horizontal support member connected to said second opposed insert member; and a display frame assembly positioned on said first and second horizontal support members;

wherein, when fastener members are inserted between said tab members, said center support member is securely affixed to said vertical upright member.

2. The floor stand display device as set forth in claim 1 wherein said first and second horizontal support members are telescopically connected to said first and second opposed insert members, respectively, wherein display frame assemblies of different sizes can be accommodated.

3. The floor stand display device as set forth in claim 1 further comprising a first L-shaped side support member connected to said first horizontal support member and a second L-shaped side support member connected to said second horizontal support member.

4. The floor stand display device as set forth in claim 3 further comprising means for attaching said first and second L-shaped side support members to said display frame assembly.

5. The floor stand display device as set forth in claim 1 wherein said display frame assembly, said first horizontal support member, and said first insert member are connected together with a first common fastening member, and wherein said display frame assembly, said second horizontal support member, and said second opposed insert member are connected together with a second common fastening member.

6. A floor stand display device comprising:

a portable base member;

a hollow tubular vertical upright member connected to said base member;

a center support member connected to said vertical upright member, said center support member having a body portion, a first insert member, and a second opposed insert member;

a first hollow horizontal support member telescopically connected to said first insert member;

a second hollow horizontal support member telescopically connected to said second opposed insert member;

a display frame assembly connected to said first and second horizontal support members;

wherein said first and second horizontal support members are adjustable longitudinally relative to said first and second opposed insert members, respectively, in order to accommodate display frame assemblies of different sizes.

7. The floor stand display device as set forth in claim 6 wherein said center support member further comprises a pair of spaced apart tab members positioned inside said hollow tubular vertical upright member, and wherein fastener members inserted between said tab members securely affix said center support member to said vertical upright member.

8. The floor stand display device as set forth in claim 6 further comprising a first L-shaped side support member connected to said first horizontal support member and a second L-shaped side support member connected to said second horizontal support member.

9. The floor stand display device as set forth in claim 8 further comprising means for attaching said first and second L-shaped side support member to said display frame assembly.

10. The floor stand display device as set forth in claim 6 wherein said display frame assembly, said first horizontal support member and said first insert member are connected together with a first common fastener member, and wherein said display frame assembly, said second horizontal support member, and said second opposed insert member are connected together with a second common fastener member.

11. The floor stand display device as set forth in claim 6 wherein said display frame assembly comprises a plurality of frame members connected together and each of said frame members has an elongated channel therein, wherein said first and second horizontal support members are positioned within at least one of said elongated channels.

12. The floor stand display device as set forth in claim 6 wherein said display frame assembly comprises a plurality of frame members connected together, one of said frame members having slot means therein for entry and removal of display indicia from said frame assembly.

* * * * *

UNITED STATES PATENT AND TRADEMARK OFFICE

CERTIFICATE OF CORRECTION

PATENT NO. : 5,915,656
DATED : June 29, 1999
INVENTOR(S) : Ronald E. Grewe

It is certified that error appears in the above-identified patent and that said Letters Patent is hereby corrected as shown below:

Column 4,
Line 67, "inset" shoul be -- insert --.

Signed and Sealed this

Twenty-sixth Day of February, 2002

*Attest:*

*Attesting Officer*

JAMES E. ROGAN
*Director of the United States Patent and Trademark Office*